US005629064A

United States Patent [19]

Sherman et al.

[11] Patent Number: 5,629,064

[45] Date of Patent: May 13, 1997

[54] MASK USED FOR GROUTING TILE

[76] Inventors: Paul L. Sherman; Kay Sherman, both of 380 Rte. #18, East Brunswick, N.J. 08816

[21] Appl. No.: 644,365

[22] Filed: May 10, 1996

[51] Int. Cl.[6] ..... B32B 9/00

[52] U.S. Cl. ..... 428/42.3; 428/42.2; 428/47; 428/48; 428/49; 428/119; 428/134; 428/137; 428/194; 428/343; 156/60; 156/63; 52/387; 52/390

[58] Field of Search ..... 428/343, 48, 49, 428/194, 47, 119, 137, 42, 41; 52/387, 390; 156/60, 63

[56] References Cited

U.S. PATENT DOCUMENTS

| | | | |
|---|---|---|---|
| 3,208,190 | 9/1965 | Kakos et al. | 52/390 |
| 3,716,432 | 2/1973 | Morrison | 156/63 |
| 3,753,827 | 8/1973 | Kober | 165/307 |
| 3,873,405 | 3/1975 | Wilkes | 161/113 |
| 4,060,436 | 11/1977 | Carlin | 156/63 |
| 4,082,875 | 4/1978 | Citron | 428/134 |
| 4,931,331 | 6/1990 | Owens | 428/47 |
| 5,362,560 | 11/1994 | Ehrhart et al. | 428/343 |
| 5,447,760 | 9/1995 | Watras | 428/13 |

*Primary Examiner*—Patrick Ryan
*Assistant Examiner*—Abraham Bahta

[57] ABSTRACT

A mask to be used for grouting tile which when utilized eliminates washing and cleaning of the tiles, thereby saving the time and labor required for washing and clean-up of the grout material.

11 Claims, 2 Drawing Sheets

MASK USED FOR GROUTING TILE

BACKGROUND OF THE INVENTION

This invention relates to a mask for grouting tile where currently tile setters both professional and amateur (home craftsmen, commonly called do it yourselfers) utilize a system of mixing the grout and pouring or troweling it into the space between the individual tiles. In going thru this proceedure to grout the tile the amatuer or the craftsman pours the grout over the entire tile and squeeges the grout into the spacing in between each individual tile. This method of grouting tile has been used for centuries. However, after one squeeges the grout over the tile the remaining grout that is not accepted by the spacing between the tiles has to be removed by wiping up the excess grout on the tile before it dries with a wet sponge, or wiping rags.

This method is very time consuming, sloppy and dirty, often taking many wipings over the tiles with both wet and dry applicators to remove all the grout which constitutes the residual excess that must be used in order to grout the tiles properly.

By utilizing this invention for the purposes of tile grouting the use of sponges and towels to wipe up any excess is almost totally eliminated allowing the Job to come out clean and neat.

This new product saves time, money, and the environment because of the practical elimination of the need to clean the tiles and disposal of the buckets of residual waste water and grout does not get directly into the sewage system.

In many cases and in particular when grouting marble tile the old conventional method stains the tile when using colored grout.

The reason these stains occur is because unlike other filler materials grout used in tile applications is ground to a fine powedery consistancy and then when coloring dyes are applied the fine powder of the coloring material penetrates the micropourous surface of the tile making it very difficult to remove the excess grout which has been washed into the pores of the tile.

The utilization of the mask as outlined will prevent staining from happening, depending upon the nature of the dye and the composition of the tile could be permanent.

Once the tile has been grouted the grout can be wiped over the surface of the tile which is totally covered by the mask. Because the mask is impervious to (1) the grout, (2) the dye in the coloring matter, and (3) to the water, the tile is fully protected.

This invention will allow tile manufacturers the ability to apply the mask to the tile or tiles during the manufacturing process prior to packing and shipping. The professional tile setter and the do it yourself home craftsman will also be able to apply the mask themselves in consumer and professional marketed versions.

The mask can be applied to the surface of any tile, including, but not limited to ceramic, marble, quarry and composition tiles that require grouting.

SUMMARY OF THE INVENTION

The developement of a masking sheet pre cut to the specific size of the tiles which are being installed so that the professional and the do it yourself craftsman can easily grout a tiled floor without the tedious and laborious task of endless hours of wiping and cleaning the tiles before the excess grout dries to a hardened mass.

A unique feature of this invention is that the masks can be precut & factory applied or applied on the job to accomodate most any configuration of tile by size and shape, whether the tiles are large or small or if the tiles are manufactured in fancy configurations such as fleur de lis, round, oblong or any other configurations which requires special attention while being grouted.

DETAILED DESCRIPTION OF THE INVENTION

Figure 1:
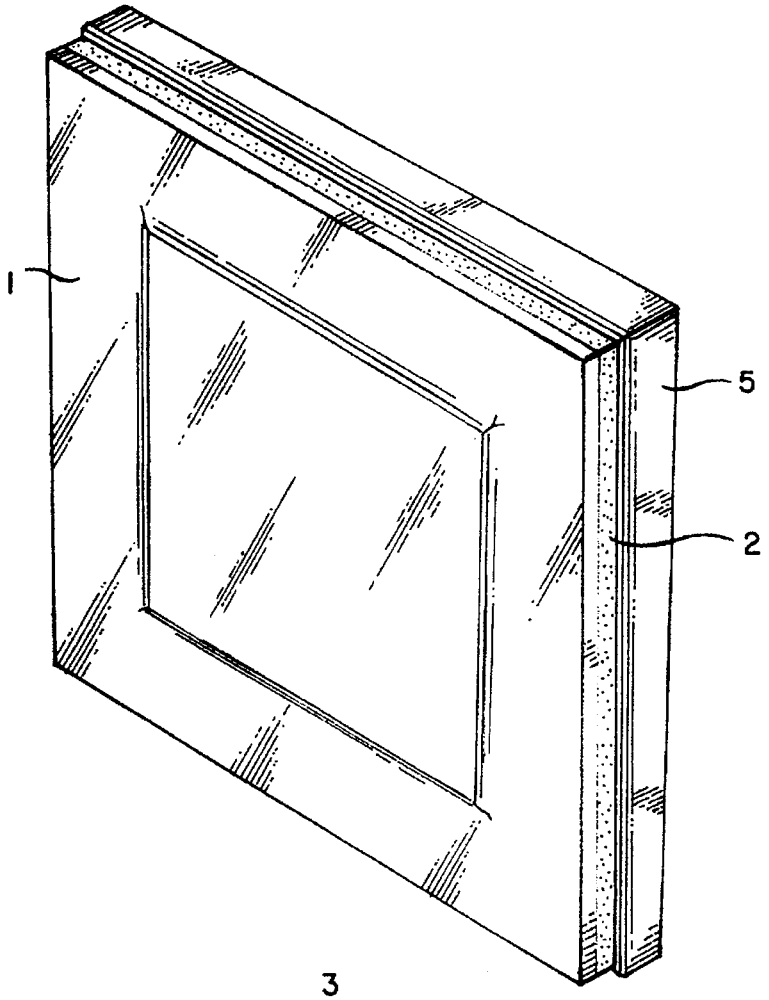
FIG. 1 is a perspective of the tile with the mask attached showing the position of the mask on the tile.
Figure 2:
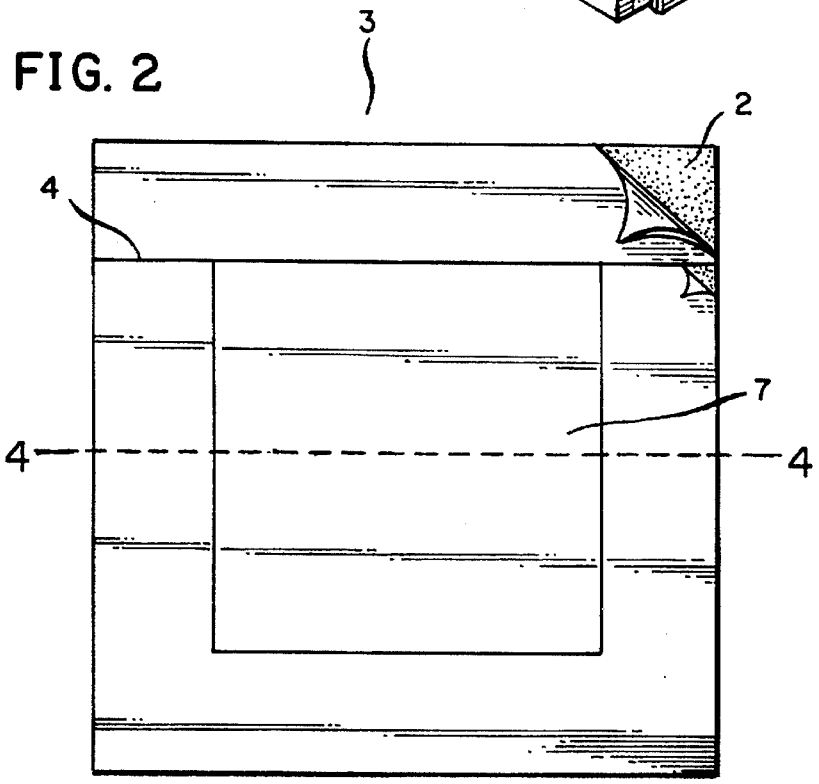
FIG. 2 Is a bottom view of the mask showing the position of the splits, with the alternative of horizontal and vertical straight line splits from the backside showing the peel off areas.
Figure 3:
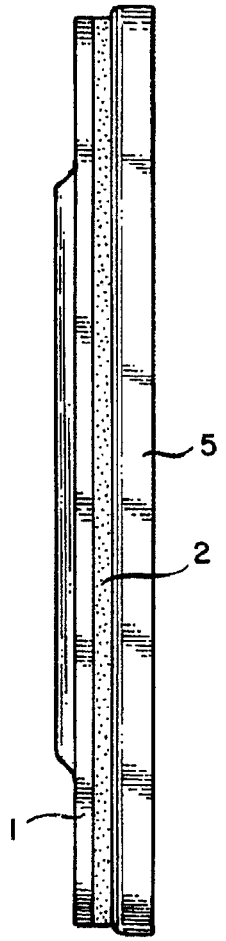
FIG. 3 Is a side view of the mask showing the layering of the sections and relative position on the tile.
Figure 4:
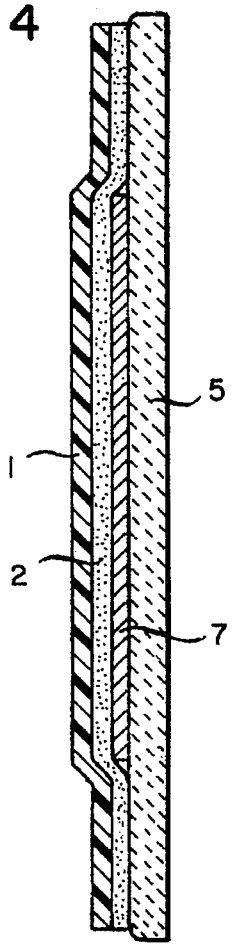
FIG. 4 Is a cross section of the mask and tile taken along line 4—4 in FIG. 2.
Figure 5:
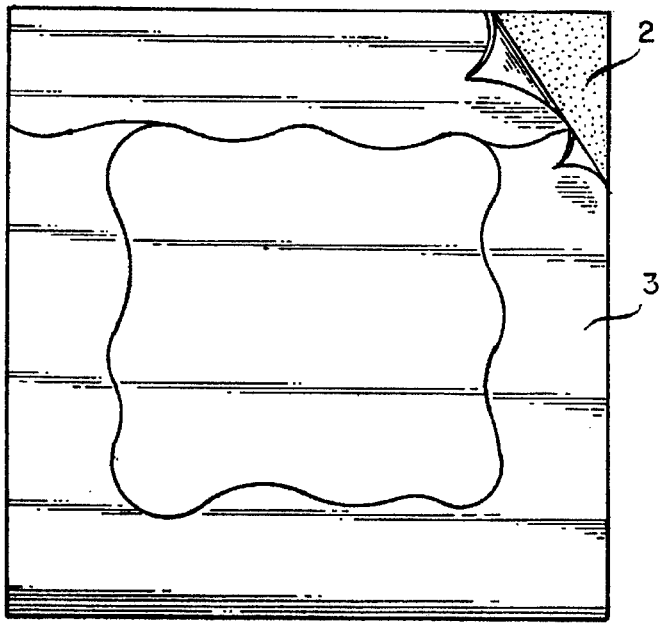
FIG. 5 Is a bottom view that shows the preferred method of the line splits in a sine wave configuration on all four sides from the backside showing the peel off areas.
Figure 6:
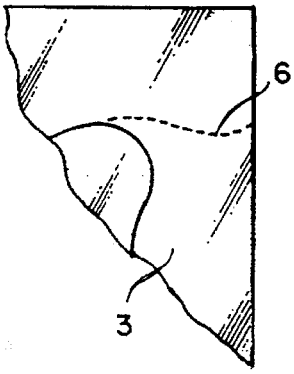
FIG. 6 Is a top view of the mask where one corner or all four corners are through perforated.

As depicted in FIG. 1 and in FIG. 4 the body of the tile FIG. 1-5 being of a rigid material is overlayed by the mask which is a layered sheet composed of a impervious layer of plastic FIG. 3-1 or high gloss enameled paper which resists the flow of the wet grout through to the tile FIG. 3-5.

Adhereing to this impervious layer is a layer of adhesive material FIG. 1-2 which is attached to a layer of silicon coated paper that allows for peeling back and release from the adhesive layer, and exposing the adhesive for positioning on to the tile surface FIG. 2-2, and the center insert of silicon coated paper FIG. 2-7 remaining intact on the adhesive side of the mask remains in position at the center of the mask when positioned to the tile FIG. 2-7.

In FIG. 2 the body of the mask can be made with straight line splits FIG. 2-4 that are horizontal and perpendicular, however this is not the preferred method and the configuration as shown in FIG. 5 allows for easier removal of the mask after grouting.

The splits are kiss die cut into the silicone coated paper portion of the mask and do not perforate thru to the impervious portion of the mask, the process used in performing this operation is called kiss perforating, whereby the die cutting machine performing the operation only cuts to the depth of the silicone coated paper and makes a pressure line not a perforation.

This pressure line when bent over at 90 degrees cracks the silicon paper and allows the edge portion of the silicone sheet to be removed FIG. 2-4 and FIG. 5-3

FIG. 4 shows a cross section in the center of the mask attached to the tile. The silicon coated paper in the center of the mask being intact and with the impervious outer surface of the mask as it would be positioned on the tile.

Surrounding the silicon coated paper is the adhesive layer FIG. 4-2 attached to the impervious sheeting, which attaches to the tile FIG. 4-5

The adhesive layer FIG. 3-2 is formulated for the individual application depending upon the required shelf life of the product so that it will always be easily removable depending upon one or more of the following criteria, weather, storage temperature, shelf life after application to the tile, and ease of removal when the mask is removed and discarded.

FIG. 5 shows the preferred method of forming the splits so that the silicone coated paper is removed from the impervious adhesive face of the mask and thereby leaves the inner center of the silicone coated portion of the mask intact. The utilization of the sine wave split provides for easy removal of the mask once the tile has been grouted. If the lines are not in a sine wave configuration and the splits are made in straight lines removal of the mask is more difficult and may cause tearing and spillage of the excess dried up grout when the mask is removed.

The mask in its entirety can be removed after the grout has set for about 1 hour or less, thereby fulfilling the purpose of this invention to minimize the amount of clean-up and work associated with grouting the tiles. To effectively remove the mask a perforated line FIG. 6—6 to the outer edge of the mask when broken with a knife or razor by lightly cutting into the center of the mask and cutting to the perforation breaks the bond of the mask to the tile on the top side of the mask and the mask can be lifted easily at this position and discarded together with the dried excess grout.

By allowing the grout to fully set up into a hardened state makes removal of the mask more difficult and adds to the clean up. Therefore the mask should be removed in about an hour, or when the grout sets up.

The dimensional configuration of the distance from the split to the outer edge of the mask should vary with the size of the tile, however, on very large tiles of 12 to 18 inches there is no need to extend the adhesive layer more that 2 inches at the crest of the wave FIG. 5-1 or more than 1 inch at the bottom of the wave FIG. 5-4. In small tiles these dimensions will vary proportionately.

We claim:

1. A mask comprised of a layered impervious sheet of plastic or enameled high gloss coated paper with adhesive backing which has been scored to a sine wave configuration, the center insert which allows for quick easy application and removal remains intact as the mask is positioned to the tile body, which when applied to the surface of any tile that requires grouting will cover the entire surface protecting it from the grout which is intended to be installed into the space surrounding the tile itself.

2. A mask comprised of a layered impervious sheet of plastic or enameled high gloss coated paper with adhesive backing which has been scored with straight lines, triangular wave or square wave as designated configuration the center insert which allows for quick easy application and removal remains intact as the mask is positioned to the tile body, which when applied to the surface of any tile that requires grouting will cover the entire surface protecting it from the grout which is intended to be installed into the space surrounding the tile itself.

3. A mask of claim 1 wherein the shapes of the tile is patterned into specific shapes square, fleur de lis, oblong, rectangular, semi-circular, circular, trapazoid, diamond, octagon configuration, wherein the mask. requires die cutting to specific patterns.

4. A mask of claim 2 wherein the shapes of the tile is patterned into specific shapes, square, fleur de lis, oblong, rectangular, semi-circular, trapazoid, diamond, octagon configuration, wherein the mask requires die cutting to those specific patterns.

5. A mask as in claim 1 which is to be used for tiles which require the use of grout.

6. A mask as in claim 2 which is to be used for tiles which require the use of grout.

7. A mask which is impervious to grout and water and permits the grouting of the tile without discoloring the surface of the tile or allowing the grout to adhere to areas of the tile which would normally be covered by grout without the mask.

8. A mask as in claim 1 which allows for quick release of the subject mask by virtue of the configuration of the sine wave split by utilizing the corner top side perforation for removal of the mask.

9. A mask as in claim 1 which allows for quick release of the subject mask by virtue of the configuration of the straight lined split, a triangular wave split or a square wave split by utilizing the corner top side perforation for removal of the mask.

10. A mask as in claim 2 which allows for quick release of the subject mask by virtue of the configuration of the sine wave split by utilizing the corner top side perforation for removal of the mask.

11. A mask as in claim 2 which allows for quick release of the subject mask by virtue of the configuration of the straight lined, triangular wave or square wave split by utilizing the corner top side perforation for removal of the mask.

* * * * *